US006336834B1

(12) United States Patent
Nedderman, Jr. et al.

(10) Patent No.: US 6,336,834 B1
(45) Date of Patent: Jan. 8, 2002

(54) SELF-DEPLOYING RUDDER FOR HIGH SPEED MANEUVERABILITY OF JET-POWERED WATERCRAFT

(75) Inventors: William H. Nedderman, Jr., Middletown; William M. Serth, Newport, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 22 days.

(21) Appl. No.: 09/638,798

(22) Filed: Aug. 10, 2000

(51) Int. Cl.[7] ..... B63H 11/117
(52) U.S. Cl. ..... 440/43; 114/162
(58) Field of Search ..... 114/162; 440/38, 440/40, 41, 42, 43

(56) References Cited

U.S. PATENT DOCUMENTS 3,982,494 A * 9/1976 Posti ..... 440/43
4,318,701 A * 3/1982 Kirkwood ..... 440/51
5,642,684 A * 7/1997 Aker ..... 440/43
6,086,437 A * 7/2000 Murray ..... 440/43

* cited by examiner

*Primary Examiner*—Stephen Avila
(74) *Attorney, Agent, or Firm*—Michael J. McGowan; James M. Kasischke; Prithvi C. Lall

(57) ABSTRACT

A rudder assembly is attached to the nozzle of a jet-powered watercraft by a spring-loaded pivot so as to turn with the nozzle when the craft is steered. The rudder assembly has two flat plate rudders with a baffle plate attached perpendicularly between the rudders. The baffle plate partially covers the nozzle when the watercraft is at rest and is held in position by the spring-loaded pivot. At slow speeds the rudders are parallel to the water jet flow from the nozzle to aid in steering the watercraft. At higher speeds, the force of the water jet against the baffle plate overcomes the spring force to pivot the rudder assembly up and away from the nozzle such that steering is provided by directing the nozzle. In an imminent high-speed collision situation, the panic reaction is to shut off the throttle, which abruptly ends the jet flow from the nozzle. The spring-loaded pivot forces the baffle plate back over the nozzle and the rudders are again positioned parallel with the nozzle to provide steering without any flow from the nozzle.

5 Claims, 2 Drawing Sheets

SELF-DEPLOYING RUDDER FOR HIGH SPEED MANEUVERABILITY OF JET-POWERED WATERCRAFT

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to jet-powered watercraft, and more particularly to an auxiliary rudder for the watercraft, which deploys at high speeds when the throttle is shut.

(2) Description of the Prior Art

It is known that the lack of off-throttle steering in jet-powered watercraft, particularly in the one and two person craft typically referred to as Personal Watercraft (PWC). Steering for PWC's is normally provided by aiming the thruster jet nozzle. An experienced driver of such a craft will maintain throttle and steer the craft to avoid a collision. However, in the panic of a high-speed collision avoidance situation, inexperienced drivers have a tendency to let go of the throttle. With the throttle at idle, there is no steerage and the craft proceeds straight, possibly leading to the collision sought to be avoided by letting go of the throttle.

A number of jet-powered watercraft rudder systems for steering at low speeds are available in the prior art. U.S. Pat. No. 3,982,494 to Posti describes an auxiliary rudder coupled to a hydraulic cylinder. The cylinder maintains the rudder within the flow stream of the thruster jet at low speed. At high speed, water pressure from the pump chamber of the thruster operates the cylinder to raise the rudder. In a panic situation as described above, the reaction time of the cylinder to the decreased pressure in the pump chamber would be too long to provide the almost instantaneous rudder deployment required.

U.S. Pat. No. 4,779,553 to Wildhaber, Sr. describes a flat plate rudder pivotally attached to an outboard jet motor, so as to be within the flow of the thruster jet. At slow speeds, the rudder provides steering for the craft. As speed increases, the water force pivots the rudder out of the flow, such that steering is controlled by directing the thruster jet. In a high-speed panic situation, with the throttle cut off, the flow of the thruster jet is stopped. However, the water flow over the rudder from the speed of the craft would maintain the rudder in the raised position.

U.S. Pat. No. 3,976,026 to Eastling provides a steering plate, which is located below the thruster jet flow and is attached to the thruster so as to maintain the same orientation as the flow. The plate is continuously deployed to provide auxiliary steering at all speeds. However, being deployed below the flow subjects the plate to damage from rocks and other obstacles. A spring-loaded mechanism allows the plate to deflect upwards when an obstacle is encountered, so as to mitigate, but not eliminate, damage.

SUMMARY OF THE INVENTION

Accordingly, it is an object of the present invention to provide a rudder for high speed steering of a jet-powered watercraft.

Another object of the present invention is to provide a rudder for high speed steering of a jet-powered watercraft, which self-deploys when the watercraft throttle is shut off.

Still another object of the present invention is to provide a rudder for high speed steering of a jet-powered watercraft, which does not protrude below the jet flow during normal operation of the watercraft.

Other objects and advantages of the present invention will become more obvious hereinafter in the specification and drawings.

In accordance with the present invention, a rudder assembley is pivotally attached to the nozzle of a jet-powered watercraft, so as to turn when the nozzle is turned. At rest, a baffle plate of the assembly partially covers the nozzle and is held in place by a spring at the pivotal attachment point. One or more flat plate rudders are attached perpendicularly to and extend away and down from the baffle plate, parallel with the jet flow from the nozzle. Once the jet begins operating, the force of the water jet against the baffle plate overcomes the spring force and the rudder assembly begins to pivot up and away from the nozzle. At slow running speeds, the force from the jet does not completely overcome the spring force, thus allowing the rudders to be partially within the jet flow and thus contribute to slow speed maneuverability of the watercraft. At high speeds, i.e., at high jet velocities, the jet forces the rudders nearly out of the jet flow and steering is provided by the nozzle direction. The rudders are pivoted up and away from the nozzle so as to prevent damage from underwater obstacles. In an imminent collision situation at high speeds, the panic reaction is to shut off the throttle, which abruptly ends the jet flow from the nozzle. The spring forces the baffle plate back over the nozzle and the rudders are again positioned parallel with the nozzle to provide steering without any flow from the nozzle. Thus the rudder assembly provides a self-deploying, high speed steering capability when the throttle is shut down.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like numerals refer to like parts and wherein:

FIG. 2B depicts an end view of a second embodiment of the rudder assembly.

DESCRIPTION OF THE PREFERRED EMBODIMENT

Figure 1:
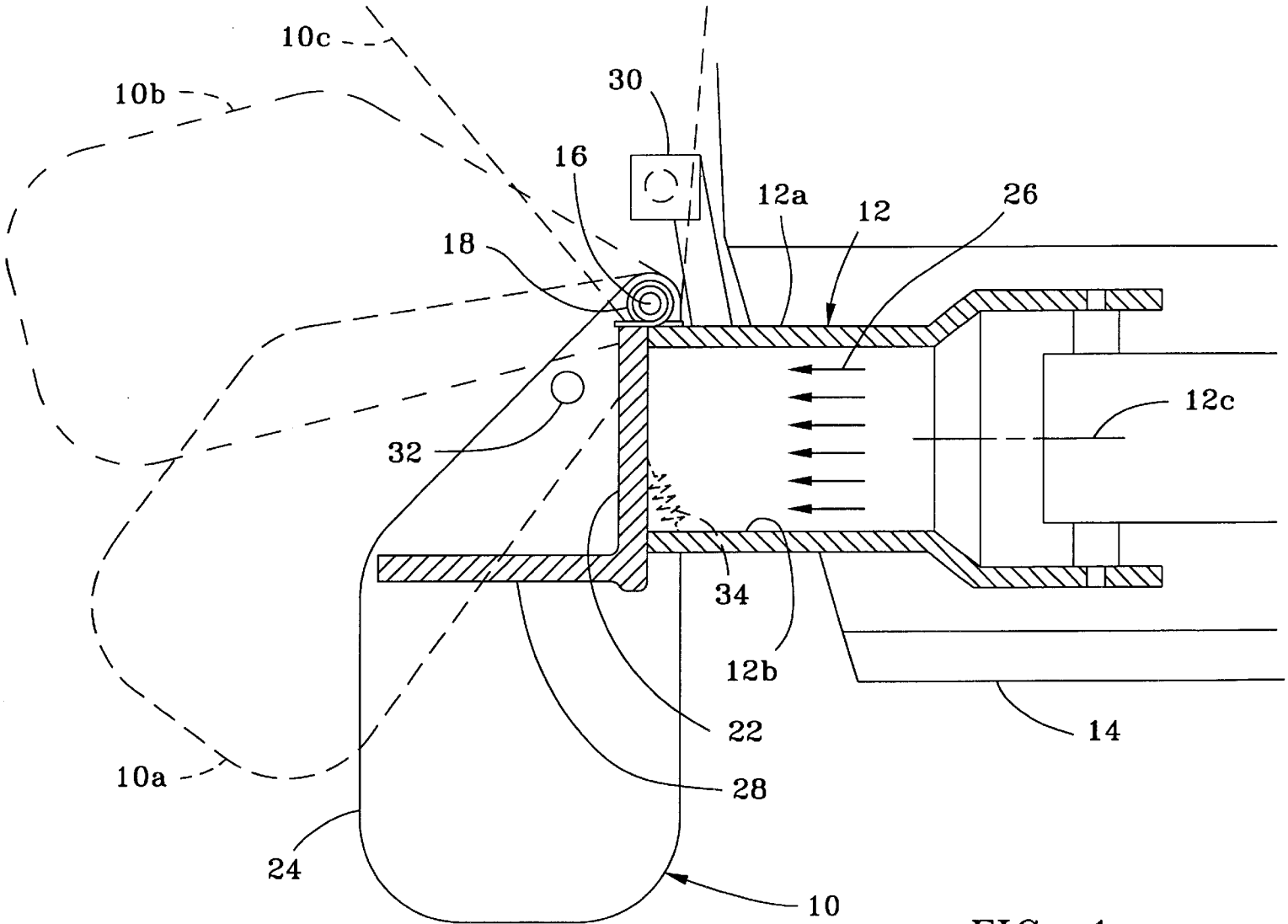
FIG. 1 depicts a side cross sectional view of the rudder assembly of the present invention attached to the nozzle of a jet-powered watercraft.

Referring now to FIG. 1, there is shown in partial cross section a rudder assembly 10 attached to the jet nozzle 12 of a jet-powered watercraft, shown partially at 14. Steering for watercraft 14 is normally provided by turning nozzle 12. Assembly 10 is attached to nozzle 12 so as to turn with nozzle 12. Further, assembly 10 is pivotally attached to nozzle 12 at point 16, generally being at the top most portion 12*a* of nozzle 12. Spring 18, located about pivot point 16, biases assembly 10 such that baffle plate 22 of assembly 10 is held over nozzle opening 12*b*, covering opening 12*b*. Flat plate rudders 24 of rudder assembly 10 are attached perpendicularly to each side of baffle plate 22 and extend away from nozzle 12, such that the plane of the plates is generally parallel with axis 12*c* of nozzle 12. At slow running speeds, when the flow of water through nozzle 12, denoted by arrows 26, is small, flow 26 against plate 22 only partially overcomes the bias of spring 18, such that assembly 10 begins to pivot about point 16, as denoted by dashed outline 10*a*. In this position, rudders 24 are within flow 26 and assist in steering watercraft 14. At higher speeds, flow 26 forces assembly 10 to pivot further about 16, as denoted by second dashed outline 10*b*. In this position, rudders 24 do not contribute significantly to steering watercraft 14.

In a panic situation, such as an imminent collision, the normal reaction of an inexperienced operator is to release the throttle so as to stop jet flow 26. In typical watercraft without assembly 10, no steering is available without flow 26 through nozzle 12. Studies by the National Transportation Safety Board and the United States Coast Guard indicate that the lack of off-power steering is a contributing factor in many watercraft accidents. However, for watercraft 14 in a high speed, no-flow situation, the bias of spring 18 causes assembly 10 to pivot back to its original position, i.e., baffle plate 22 covers nozzle 12 and rudders 24 extend parallel to axis 12*c*. With rudders 24 in this position, they again provide steering capability when nozzle 12 is turned, as described previously for the case of slow running speed.

The invention thus described consists of a baffle plate and two flat plate rudders each attached perpendicularly at one of the edges of the baffle plate. This assembly is easily mounted to the nozzle of a jet-powered watercraft with a spring-loaded hinge so attached to the nozzle as to turn with the nozzle. With little or no flow from the nozzle, the spring-loaded hinge maintains the baffle at least partially over the nozzle and the rudders positioned generally in the water flow, behind the nozzle. In this position, the rudders aid in steering the watercraft when the nozzle is turned. At high speeds, the jet flow impacts the baffle plate and overcomes the spring force to pivot the assembly about the hinge. This raises the baffle plate and rudders effectively out of the water flow, such that steering is accomplished primarily by directing the nozzle. When the throttle is turned off at high speeds, stopping the jet flow, the spring-loaded hinge forces the baffle back over the nozzle, with the rudders again in position to provide maneuvering when the nozzle is turned.

Figure 2A:
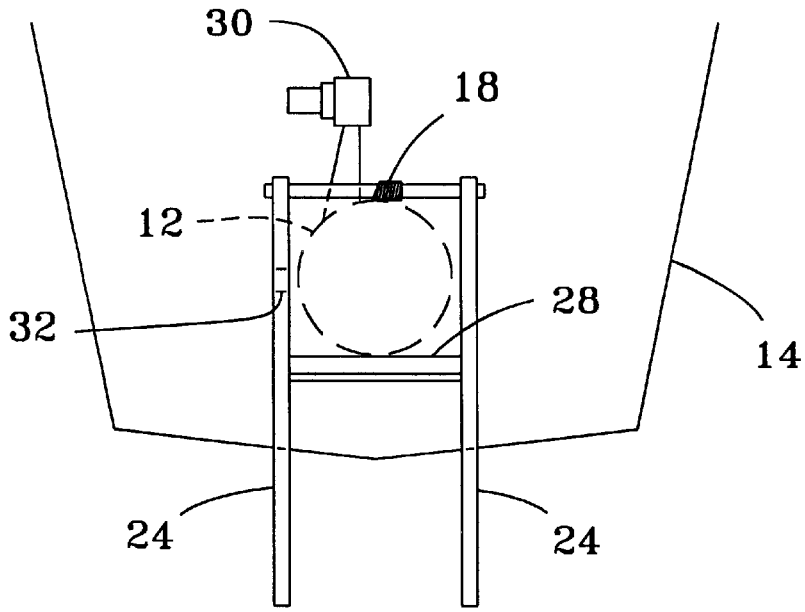
FIG. 2A depicts an end view of a first embodiment of the rudder assembly.
Figure 2A:
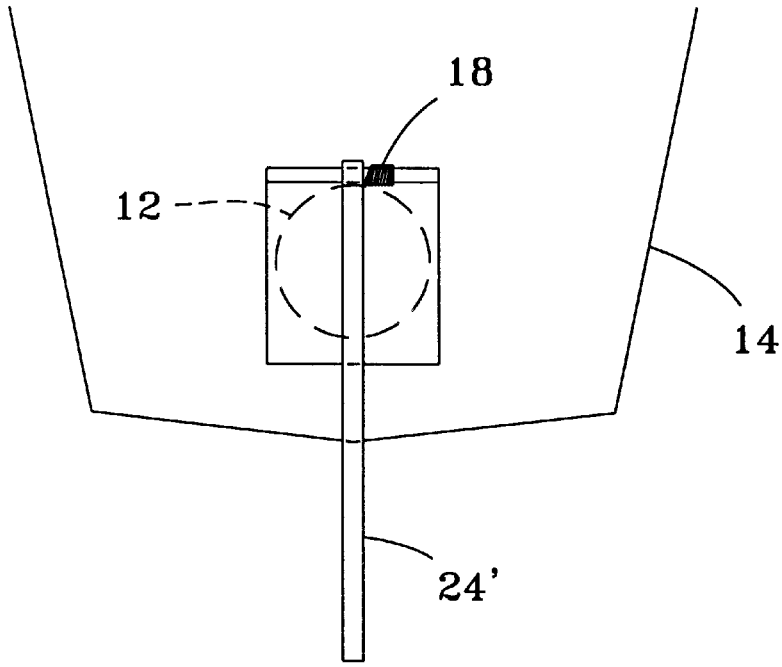

Although the present invention has been described relative to a specific embodiment thereof, it is not so limited. For example, the attachment of the assembly to the nozzle can be by tack welding the spring-loaded hinge to the nozzle, or the assembly can be bolted or strapped to the nozzle so as to be removable for repair. Further attachment methods include clamping or the use of a mounting ring to fit over the nozzle. In the preferred embodiment of FIG. 1, assembly 10 has two flat plate rudders 24, as also shown in the end view of FIG. 2A. In this embodiment, the rudders are positioned to the outside of flow 26. FIG. 2B shows a second embodiment having a single rudder 24'. In order to provide the same steering force, rudder 24' is larger than either of rudders 24 of FIGS. 1 and 2A. It is also noted that a single rudder would be positioned in the middle of flow 26, and due to its increased size, may impede flow characteristics. FIGS. 1 and 2A also show brace 28 between rudders 24. Depending on the size of the watercraft and rudders 24, brace 28 may be removed. The rudder assembly can also be made to lock in the raised position. A solenoid switch 30 may be mounted to watercraft 14 and be made to engage a bore 32 on rudder 24 to keep assembly 10 in a full raised position, shown partially as outline 10*c* in FIG. 1. The solenoid can be made to disengage when the throttle is completely released, thus lowering the assembly 10 only in an emergency situation. Finally, the embodiment of FIG. 1 depicts spring 18 serving to bias baffle 22 against nozzle opening 12*b*. Other biasing methods can be successfully employed, e.g., coil spring 34 (shown in phantom in FIG. 1) can be attached between the nozzle 12 and baffle plate 22.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An assembly for attachment to a jet nozzle of a jet-powered watercraft, the assembly comprising:

a baffle plate;

at least one rudder plate fixed directly to the baffle plate;

a hinge joint joined directly to the nozzle between the nozzle and the baffle plate allowing rotation of the baffle plate and the at least one rudder plate relative to the nozzle, the baffle plate being biased against an opening of the nozzle, the at least one rudder plate being in a vertical position to assist in steering the watercraft when the baffle plate is against the opening, water flow from the nozzle opening overcoming the bias to rotate the baffle plate and the at least one rudder plate about the hinge joint to reduce the steering assistance of the at least one rudder plate; and a torsion spring placed about the hinge joint to normally bias the baffle plate against the opening.

2. The assembly of claim 1 wherein the at least one rudder plate comprises two rudder plates attached at opposite edges of the baffle plate.

3. The assembly of claim 1 wherein the assembly is lockable in a position with the baffle plate rotated fully away from the opening.

4. The assembly of claim 3 further comprising a solenoid switch engaging a bore on the assembly to lock the assembly in the fully rotated position, the solenoid disengaging the bore when a throttle controlling the water flow from the nozzle is released.

5. The assembly of claim 2 further comprising a brace affixed to and extending between the two rudder plates.

* * * * *